US005620628A

United States Patent [19]

Ritchie, IV

[11] Patent Number: 5,620,628

[45] Date of Patent: Apr. 15, 1997

[54] DEVICE FOR CONNECTING CONCRETE FORM PANELS ASSEMBLED ON STEPPED FOOTING

[76] Inventor: William M. Ritchie, IV, 1171 Saw Mill Hill Rd., Winsted, Conn. 06098

[21] Appl. No.: 578,438

[22] Filed: Dec. 26, 1995

[51] Int. Cl.[6] ..... E04G 11/08; E04G 17/00

[52] U.S. Cl. ..... 249/193; 249/47; 249/195

[58] Field of Search ..... 249/34, 47, 193, 249/195

[56] References Cited

U.S. PATENT DOCUMENTS

| | | | |
|---|---|---|---|
| 1,212,654 | 1/1917 | McKay | 249/193 |
| 3,167,840 | 2/1965 | Hoffman | 249/193 |
| 3,429,547 | 2/1969 | Schimmel | 249/34 |
| 4,235,411 | 11/1980 | Maier | 249/193 |

*Primary Examiner*—James P. Mackey

[57] ABSTRACT

A device is provided for connecting structural panels used to make pouring forms for concrete. It includes a pair of connecting elements dimensioned to fit between adjacent structural panels and having adjustably positioned latches and latchbolts. The device enables one pair of panels to be moved out of horizontal alignment with the adjacent pair of panels to accommodate abrupt angular steps in a foundation and still employ the standard latching positions of each panel.

4 Claims, 5 Drawing Sheets

DEVICE FOR CONNECTING CONCRETE FORM PANELS ASSEMBLED ON STEPPED FOOTING

BACKGROUND OF THE INVENTION

This invention relates generally to concrete form panels and more particularly to a connecting element used to connect two vertically offset concrete form panels and still use the standard latching positions of each panel thereby eliminating the need to connect the panels using methods other than standard latching procedure.

Over the years two basic types of concrete form panels have gained wide acceptance in the construction industry, due primarily to the speed with which they can be erected for use and dismantled for either storage or use on another project.

The first consists of a rectangular shaped steel frame approximately two feet wide by eight feet long formed by a two and one-half inch steel plate around the circumference thereof. A small ridge or lip of approximately one-half inch is formed around the periphery to hold a sheet of plywood in place therein. The sheet of plywood is supported along its back by metal angles placed at approximately two foot intervals beginning at one foot from the top and bottom of the panel and are commonly known as "Steel-Ply" panels. A plurality of panels are built into two discrete parallel lines between which is poured the concrete which sets up into a completed wall. Adjacent panels are joined to form the walls by hardware which is inserted between matching small rectangular holes cut into the sides of the steel frame approximately every six inches. Typical examples of these forms are found in U.S. Pat. Nos. 3,362,676 and 3,204,918.

Another and very popular panel consists of a rectangular sheet of one and one-eighth inch thick plywood eight feet long and ranging in width from four inches to four feet. The sheets of plywood are supported along their backs by one-quarter by two inch steel straps extending from one vertical edge to the other and are securely bolted to the plywood sheets. The centerlines of the supporting straps or whalers are positioned with decreasing spacing from top to bottom in order to support the increasing load of the wet concrete as the depth of the concrete increases.

As is the case in most concrete wall forms a plurality of panels are built into two discrete parallel lines between which is poured the concrete which sets up into the completed wall. Adjacent panels are joined to form the walls by a series of latches, rotatably attached to the left ends of the whalers, that engage latch bolts attached to the right ends of the adjacent whalers. Typical examples of this type of panel are found in U.S. Pat. No. 3,888,455.

Although both types of panels have been in wide use in the construction industry for many years, there are a number of problems associated with them. Because of the way adjacent panels are or secured to each other, adjacent panels must be almost exactly level. In order to ensure that all panels are almost exactly level great care must be taken in the preparation of the foundation wall site. However, even if great care is taken the design of many buildings is such that it is not possible to pour an entire foundation wall with the same footing elevation. In cases where a variation in footing elevation is required an abrupt step is formed in the footing. Adjacent panels on either side of such a footing step must be joined in a different manner since the attaching hardware will not work as the mounting holes are not aligned. In the past it has been common practice to "scab" together adjoining panels that are vertically offset by a stepped foundation, by nailing two-by-fours to the adjoining panels. As can be appreciated, this is highly undesirable in that much additional work is required to prepare the forms and the panels are subjected to undue wear and depreciation due to the nail holes.

The inventor herein is aware of at least three patents which disclose attempts in the prior art at solving the problem of a step between adjacent panels. These are U.S. Pat. Nos. 3,429,547, 4,235,411 and 5,265,836. The '547 patent discloses a transition member formed of two panel members which are slidingly locked together in a tongue-and-groove arrangement. This transition member fits between two standard panels and permits a variable step between standard concrete form panels. The '411 patent discloses a transition member having a slot extending the entire length of each side thereof and a special key lock type hardware is used to fit through cross shaped holes in the sides of the panels. The patent '836 does not use a transition panel but simply elongates the mounting holes in in the sides of the panels. The above mentioned patents offer solutions to the problem of vertically misaligned steel framed concrete form panels but not the unframed plywood concrete form panels, in that all three patents mention mounting means passing through the steel frames of the panel.

In the assembly of a concrete form using unframed panels a plurality of panels are assembled into two discrete parallel lines starting from one corner of the foundation and progressing from either right to left or left to right. As mentioned above the unframed panels have latches attached to the left ends of the whalers and latch bolts attached to the right ends of the whalers. It can be seen then, that as the assembly progresses the exposed ends of the panels will have latches on the ends of the whalers on one panel and latch bolts on the ends of the whalers on the other panel. It can be seen then that a transition panel would have to be configured differently to attach to panels on opposing sides of the assembled concrete form.

In order to solve these and other problems in the prior art the inventor herein has succeeded in designing and developing a pair of connecting elements which permit construction of a concrete form supported by a stepped footing and yet still be securely fastened together using standard fastening hardware.

In order to accommodate the construction of concrete forms on a footing having a step of virtually any height steel connecting elements are formed to attach to standard plywood panels on either side of a footing step. A rectangular steel tube having dimensions of one and three-eights inches thick by three inches wide by eight feet long is machined with a slot along the centerline of one of the three inch faces of the tube and extending to within approximately one inch of either end of the tube. The slot is fitted with shoulder bolts, positioned exactly as the whalers on standard form panels and will be referred to hereafter as fixed latchbolts, the spaces between the fixed latchbolts are fitted with movable latchbolts. These movable latchbolts may be positioned anywhere along the slot and locked in position by tightening into retainer plates within the tube. In order to attach the connecting element to panels on either side of a concrete form it is necessary to attach latches to the fixed latchbolts on one connecting element and to the movable latchbolts on the other. The connecting element with the vertically offset panel to the left will have latches attached to the movable latchbolts and the connecting element with the vertically offset panel to the right will have latches attached to the fixed latchbolts.

While the principal advantages and features of the present invention have been described above, a more complete and thorough understanding of the invention may be attained by referring to the drawings and description of the preferred embodiment which follow.

DESCRIPTION OF THE PREFERRED EMBODIMENTS

Figure 1:
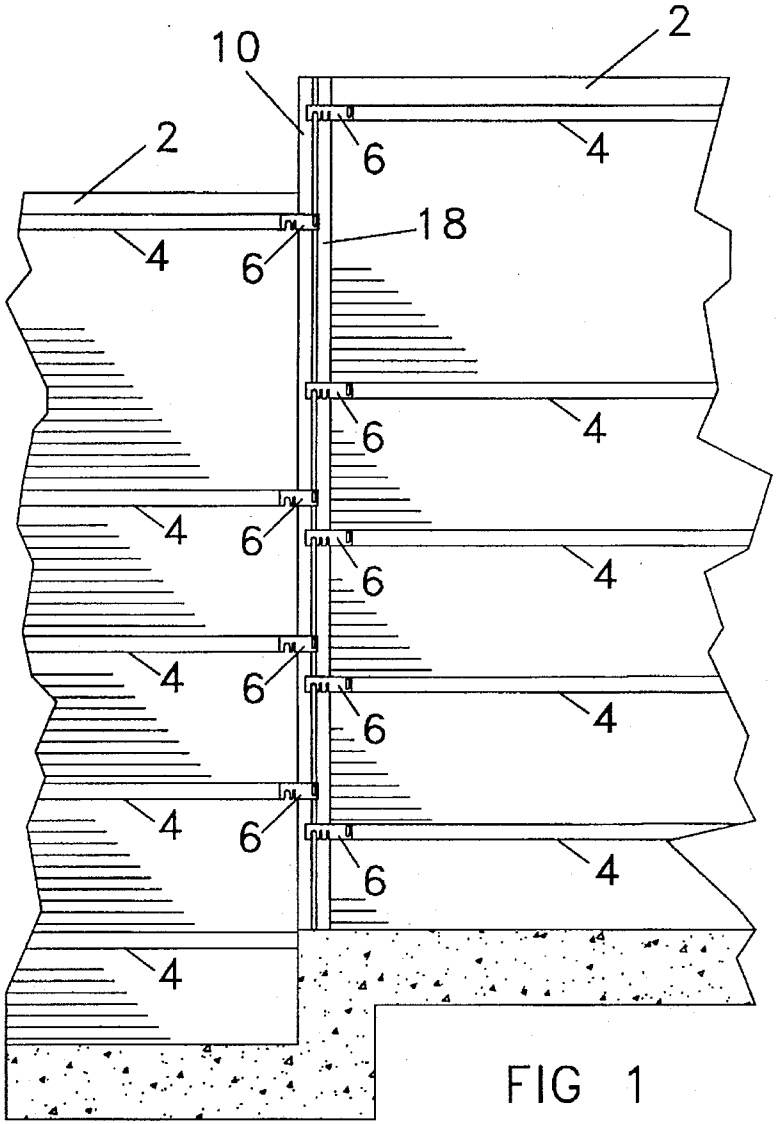
FIG. 1 is a side view of a connecting element assembled to two standard panels and accommodating a stepped foundation.
Figure 2:
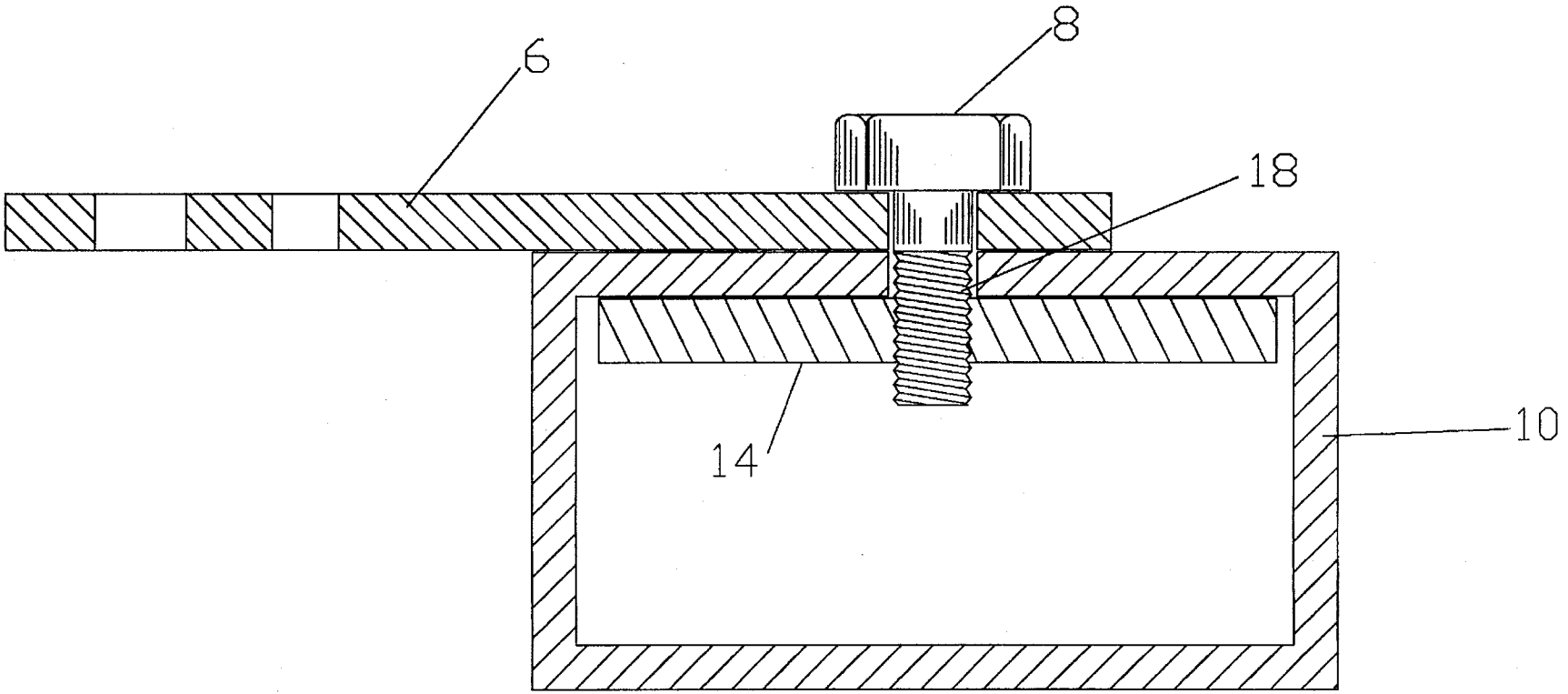
FIG. 2 is a cross-section of a connecting element through a movable latchbolt.
Figure 3:
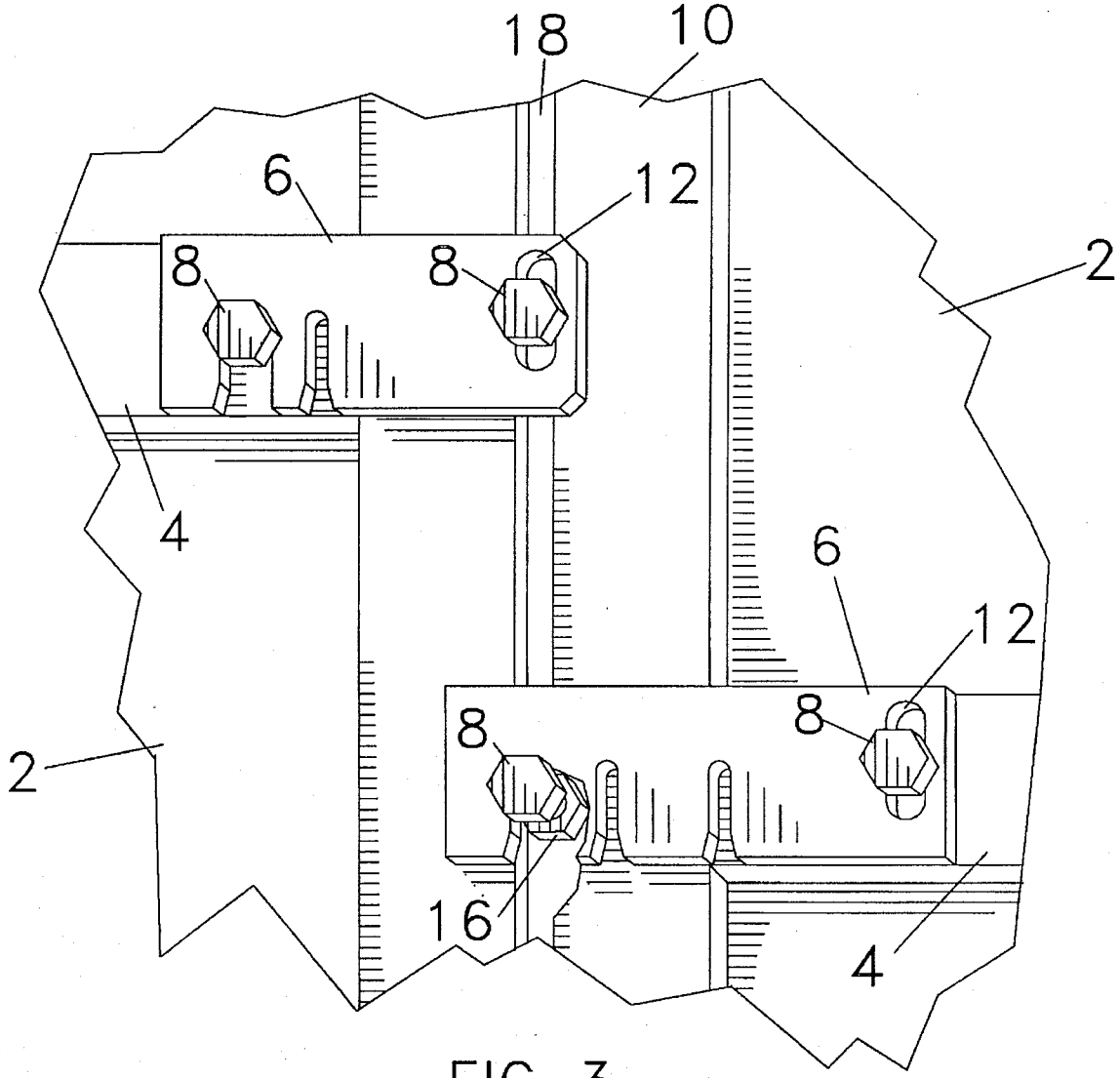
FIG. 3 is a fragmentary perspective view of a connecting element with an offset standard panel to the left and a level panel to the right.
Figure 4:
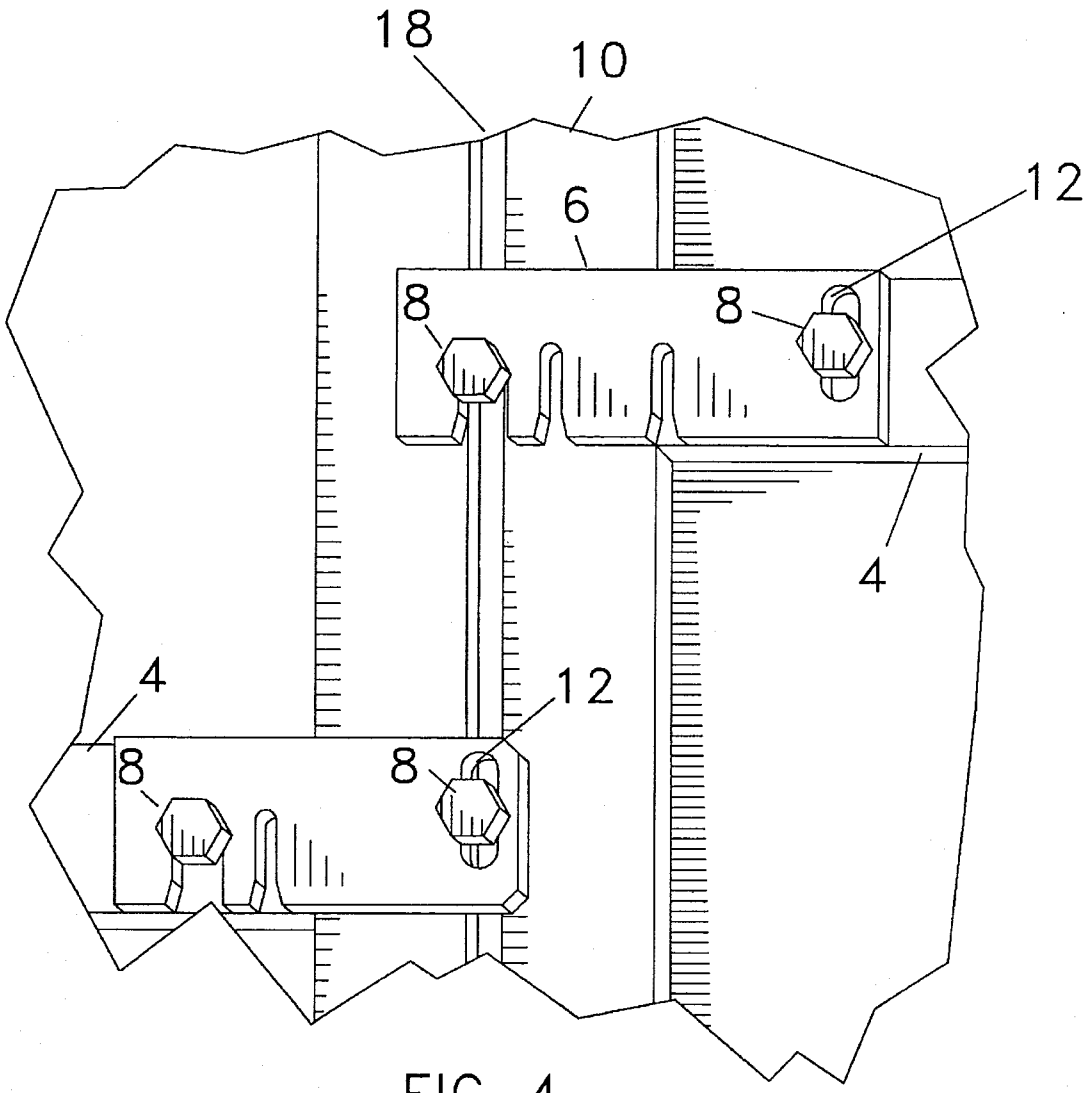
FIG. 4 is a fragmentary perspective view of a connecting element with an offset standard panel to the right and a level standard panel to the left.
Figure 5:
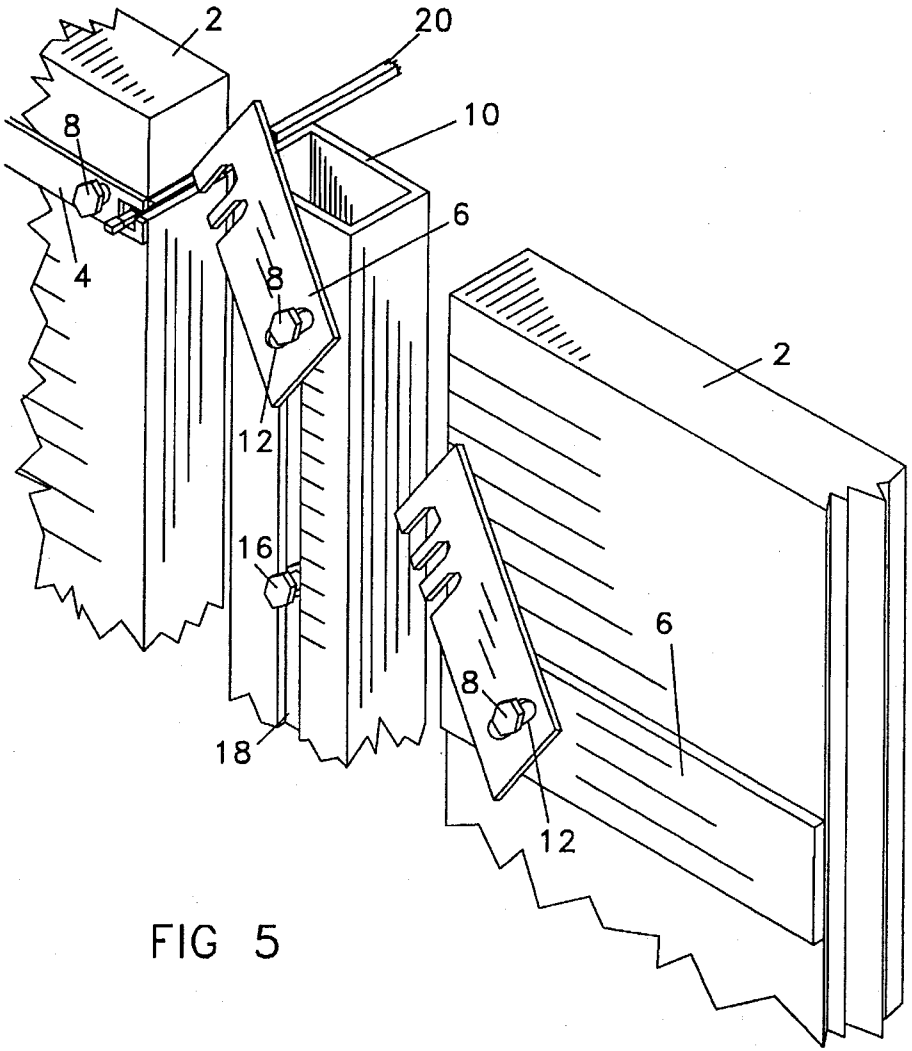
FIG. 5 is a perspective fragmentary exploded view of a connecting element and adjourning standard panels with mounting hardware.

As shown in FIG. 1 a plurality of concrete form panels 2 may be arranged in a pair of spaced apart walls to form an interior space for the pouring of a foundation wall or the like of concrete. Typically, in the prior art, these concrete form panels 2 may be four feet by eight feet or some other standardized dimension. These panels are fitted with steel reinforcing members or whalers 4. These whalers 4 are attached to the plywood concrete form panels 2 with the spacing between each whaler 4 increasing from bottom to top. The position of whalers 4 is the exactly the same on all panels 2 regardless of the width of the panel. The left end of each whaler 4 is fitted with a latch 6 that engages a latchbolt 8 that is mounted on the right end of each whaler 4 and thereby securely joins two adjacent form panels 2. The latch 6 also engages a snaptie 20 that extends between the spaced apart walls and helps to stabilize and control the distance therebetween to insure a true and plumb construction. Ideally, and for straight runs, the whalers 4 and the latches 6 and latchbolts 8 attached thereto are aligned between adjacent form panels 2. As shown in FIG. 1 in cases where the foundation is not level but contains a step, it can be seen that the whalers 4 of adjacent panels 2 are no longer aligned and the latches 6 and the latchebolts 8 attached thereto can not be used to securely join the two adjacent form panels 2. Typically, in prior art, vertically misaligned form panels would be "scabbed" together by nailing two-by-fours across the joint between the two form panels 2. This operation was of course time consuming and caused damage to the form panel 2. For those instances where a footing step is encountered, the inventor has developed a connecting element 10 constructed from rectangular steel tubing having a thickness the same as the thickness of a standard form panel 2 with a whaler 4 attached, which totals one and three eights inches. The connecting element 10 has a width of three inches and a length of eight feet. One of the three inch faces is milled with a centerline slot 18 extending to within one inch of either end of the tube, for the insertion of fixed and movably positioned latchbolts 8. With the connecting element 10 resting on the same footing as either of the offset form panels 2 the form panel 2 to the right of the connecting element 10 is joined to the connecting element 10 by engaging the latchbolts 8 (either fixed or movable) of the connecting element 10 with the latches 6 of the form panel 2 to the right. The form panel 2 to the left is joined to the connecting element 10 by engaging the latchbolts 8 of the form panel 2 with the latches 6 (either fixed or movable) of the connecting element 10. The latches 6 are affixed to the connecting element 10 by insertion of a latchbolt 8 through a hinge slot 12 in the latch 6 and threading the latchbolt 8 into either a movable retainer plate 14 or a lock nut 16 inside the connecting element 10. The connecting elements 10 will be used in pairs, one connecting element 10 having latches 6 attached to the movable latchbolts 8 and the other connecting element 10 having latches 6 attached to the fixed latchbolts 8. This pairing arrangement is necessary for the secure joining of offset form panels 2 on opposite sides of a concrete foundation form.

There are various changes and modifications which may be made to the invention as would be apparent to those skilled in the art. However, these changes or modifications are included in the teaching of the disclosure, and it is intended that the invention be limited only by the scope of the claims appended hereto.

What is claimed is:

1. A device for the connection of unframed concrete form panels vertically offset by stepped building footings, wherein the said unframed concrete form panels are provided with latch fastening means affixed to the left margin of the unframed concrete form panels and latchbolt fastening means affixed to the right margin of the unframed concrete form panels, the improvement comprising a connecting element dimensioned to fit between the vertical edges of the unframed concrete form panels to be connected and having two faces, neither of which abut the unframed concrete form panels to be connected, one of the faces is provided with a centralized slot dimensioned to receive and locate a plurality of fixedly positioned latchbolt fastening means for engagement with fastening means of adjacent unframed concrete form panels and to receive an adjustably positioned latchbolt fastening means between each pair of fixedly positioned latchbolt fastening means.

2. The device of claim 1 wherein the said slot extends from a point approximately one inch from either end to a point approximately one inch from the opposite end.

3. The device of claim 1 wherein each of said fixedly positioned latchbolt fastening means is fitted with a latch fastening means.

4. The device of claim one wherein each of said adjustably positioned latchbolt fastening means is fitted with a latch fastening means.

* * * * *